US008354089B2

(12) United States Patent
Muhler et al.

(10) Patent No.: US 8,354,089 B2
(45) **Date of Patent: *Jan. 15, 2013**

(54) CATALYTIC ETCHING OF CARBON FIBERS

(75) Inventors: Martin Muhler, Bochum (DE); Wei Xia, Essen (DE)

(73) Assignee: Bayer Technology Services GmbH, Leverkusen (DE)

( * ) Notice: Subject to any disclaimer, the term of this patent is extended or adjusted under 35 U.S.C. 154(b) by 589 days.

This patent is subject to a terminal disclaimer.

(21) Appl. No.: 12/561,334

(22) Filed: Sep. 17, 2009

(65) Prior Publication Data

US 2010/0021368 A1 Jan. 28, 2010

Related U.S. Application Data

(62) Division of application No. 12/278,592, filed as application No. PCT/EP2007/051364 on Feb. 13, 2007, now Pat. No. 7,638,111.

(30) Foreign Application Priority Data

Feb. 15, 2006 (DE) ..... 10 2006 007 208

(51) Int. Cl.
*D01F 9/12* (2006.01)

(52) U.S. Cl. ..... 423/447.2; 423/447.9

(58) Field of Classification Search ..... 423/447.2–447.9
See application file for complete search history.

(56) References Cited

U.S. PATENT DOCUMENTS

| | | | | |
|---|---|---|---|---|
| 3,769,390 | A | 10/1973 | Weisbeck et al. | |
| 5,653,951 | A | 8/1997 | Rodriguez et al. | |
| 5,874,166 | A | 2/1999 | Chu et al. | |
| 6,752,977 | B2 | 6/2004 | Smalley et al. | |
| 7,638,111 | B2 * | 12/2009 | Muhler et al. | 423/447.2 |

* cited by examiner

*Primary Examiner* — Edward Johnson
(74) *Attorney, Agent, or Firm* — Norris McLaughlin & Marcus, P.A.

(57) ABSTRACT

The present invention relates to a method for etching carbon fibers, in particular carbon nanofibers and to the carbon nanofibers obtainable by this method, and the use thereof.

2 Claims, 6 Drawing Sheets

CATALYTIC ETCHING OF CARBON FIBERS

This application is a Division of U.S. Ser. No. 12/278,592 filed Aug. 14, 2008, now allowed; which is a 371 of PCT/EP2007/051364, filed Feb. 13, 2007, which claims foreign priority benefit under 35 U.S.C. §119 of the German Patent Application No. 10 2006 007 208.1 filed Feb. 15, 2006.

The present invention relates to a process for etching carbon fibers, in particular carbon nanofibers, and also the carbon nanofibers which can be obtained by this process and their use.

BACKGROUND OF THE INVENTION

Carbon fibers such as carbon nanofibers are promising materials for many possible applications, e.g. conductive and very strong composites, energy stores and converters, sensors, field emission displays and radiation sources and also nanosize semiconductor elements and testing points (Baughman, R. H. et al., Science 297:787-792 (2002)). Another promising application is catalysis using carbon nanofibers as catalysts or as supports for heterogeneous catalysts (de Jong, K. P. and Geus, J. W., Catal. Rev.-Sci. Eng. 42:481-510 (2000)) or as nanosize reactors for catalytic syntheses (Nhut, J. M. et al., Appl. Catal. A. 254:345-363 (2003)). It is frequently necessary to modify the surface either chemically or physically for the abovementioned applications. For example, complete dispersion of the nanofibers in a polymer matrix and the resulting strong interaction between fiber and matrix is advantageous in composites (Calvert, P., Nature 399:210-21 (1999)). When used as catalyst supports, foreign atoms have to be deposited on the nanofibers. Anchor points such as functional groups or defects are necessary for this purpose. To achieve this, the inert surface of the untreated ("as-grown") nanofibers has to be modified (Xia, W. et al., Chem. Mater. 17:5737-5742 (2005)). For use in the sensor field, bonding of chemical groups or immobilization of a protein having specific recognition centers to/on the nanofibers is necessary. This is generally realized by production of functional surface groups or surface defects (Dai, H., Acc. Chem. Res. 35:1035-5742 (2002)).

Motivated by the promising possible applications, extensive studies on the surface modification and functionalization of carbon nanofibers have been carried out in the last 10 years. Among all these methods, the most intensive research has been carried out on covalent surface functionalization which is generally based on strong oxidants such as nitric acid, oxygen plasma, supercritical fluids, ozone and the like and, for example, subsequent side chain extension (Banerjee, S. et al., Adv. Mater. 17:17-29 (2005)). These oxidation methods usually increase the oxygen content of the surface, with visible physical modifications also being able to be achieved by appropriate selection of parameters. These physical changes are limited to two- or three-dimensional surface defects having unforeseeable structures in unknown positions. Under extreme conditions, for example a mixture of concentrated sulfuric acid and nitric acid, nanofibers are split into smaller fibrous units (Liu, J. et al., Science 280:1253-1256 (1998)). Identification of the surface defects remains a challenge because of the small dimensions and the curved surface of carbon nanofibers (Ishigami, M. et al., Phys. Rev. Lett. 93:196803/4 (2001)). Scanning tunneling microscopy (STM) is a very effective tool here (Osváth, Z. et al., Phys. Rev. B. 72:045429/1-045429/6 (2005)). Fan and coworkers have identified chemical surface defects by means of atomic force microscopy (AFM) using defect-sensitive oxidation with $H_2Se$ (Fan, Y. et al., Adv. Mater. 14:130-133 (2002)). In Xia, W. et al., Chem. Mater. 17:5737-5742 (2005), the alteration of the surface of carbon nanofibers is effected by deposition of cyclohexane on iron-laden carbon nanofibers. However, these secondary carbon nanofibers (tree-like structures composed of trunk and branches) are not functionalized and the surface modifications obtained cannot be used for loading with functional molecules.

The above problems apply analogously to carbon microfibers, e.g. carbon fibers produced from polyacrylonitrile (PAN) and composed of fiber bundles up to millimeter ranges, which are employed as continuous fibers in modern high-performance composites.

Despite the numerous efforts to modify the surface of carbon fibers such as carbon nanofibers, functional surface groups or surface defects have to the present time not been able to be introduced in a targeted manner by means of any of the abovementioned methods.

BRIEF DESCRIPTION OF THE INVENTION

Surprisingly, a localized etching technique by means of which surface defects can be produced at predetermined places on carbon fibers such as multiwalled carbon nanofibers (known as multiwalled carbon nanotubes, hereinafter referred to as "MWNT" or "nanofibers" for short). Etching is in this case based on gasification of carbon by means of water vapor

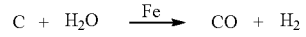

$$C + H_2O \xrightarrow{Fe} CO + H_2$$

with nanosize iron particles present on the nanofibers catalyzing the gasification. Etching occurs at the interface and is limited to the places on the carbon fibers where iron particles are present. Etching can easily be controlled by appropriate choice of the parameters for pretreatment (loading with iron, heating time, etc.) and the process parameters (reaction time, temperature, partial pressure of water, etc.). In this way, carbon fibers having spherical etching pits can be synthesized using inexpensive raw materials (water and iron) in an environmentally friendly process. In addition, the process produces hydrogen and carbon monoxide which are the main constituents of synthesis gas. The invention accordingly provides (1) a process for etching carbon fibers, which comprises
  (a) functionalization of the surface of the carbon fibers by oxidation,
  (b) deposition of metal particles on the functionalized surface,
  (c) etching of the surface by treatment with water vapor,
  (d) removal of the metal particles by acid treatment,
(2) etched carbon fibers which can be obtained by the process according to (1) and
(3) the use of the etched carbon fibers according to (2) in composites, energy stores, as sensors, as adsorbents, supports for heterogeneous catalysts and as catalytically active material after additional oxygen functionalization.

The carbon fibers according to the present invention encompass carbon nanofibers and carbon microfibers, but are not restricted thereto.

DETAILED DESCRIPTION OF THE INVENTION

Figure 1:
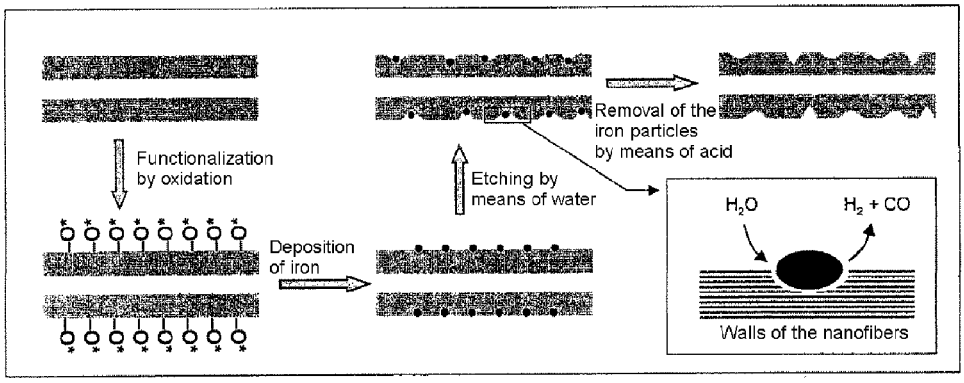
FIG. 1: Two-dimensional schematic depiction of the four main steps in the etching process. The nanofibers were functionalized on the surface by means of concentrated nitric acid to increase the number of oxygen atoms. Iron from ferrocene as precursor was then deposited from the vapor phase. The subsequent etching was carried out using 1% by volume of water vapor in helium. The metal particles were finally removed by washing with 1M nitric acid at room temperature.

The carbon fibers according to the present invention are structures which can be obtained by polymerization of unsaturated hydrocarbon compounds.

In a first preferred embodiment of the process (1), the carbon fibers are carbon nanofibers. These comprise carbon and can, for example, be produced from hydrocarbons by catalytic pyrolysis and are also obtainable from, for example, Applied Sciences Inc. (Cedarville, Ohio, USA) or Bayer MaterialScience.

Such carbon nanofibers usually have an external diameter of from 50 to 500 nm, preferably about 100 nm, an internal diameter of from 10 to 100 nm, preferably about 50 nm, and a surface area of from 10 to 60 $m^2/g$, preferably from 20 to 40 $m^2/g$. As a result of the etching process of the invention, the specific surface area of the carbon nanofibers increases to from 90 to 100 $m^2/g$.

In a second preferred embodiment of the process (1), the carbon fibers are microfibers. Such microfibers comprise, for example, carbon and are produced, for example, by pyrolysis of polyacrylonitrile fibers and can also be obtained from, for example, Zoltek Companies Inc. (St. Louis, USA) or Toho Tenax Europe GmbH. These microfibers have an external diameter of from 3 to 10 μm, preferably about 6 μm, and a surface area of less than 1 $m^2/g$. As a result of the etching process of the invention, the specific surface area of the microfibers increases to from 5 to 50 $m^2/g$.

In step (a) of the process of the invention, the surface of the carbon fibers is functionalized by oxidative treatment of the fibers. This can preferably be effected suddenly by heating with oxidizing acids or by oxygen plasma treatment. Particular preference is given to heating with nitric acid, e.g. with concentrated nitric acid.

In step (b) of the process of the invention, metal particles are applied to or deposited on the fibers which have been treated in step (a). These metal particles are preferably selected from among iron (Fe), cobalt (Co) and nickel (Ni), with Fe particles being particularly preferred. Preference is also given to from 1 to 20% by weight, preferably from 5 to 10% by weight, of metal, based on the total weight of the laden carbon nanofibers, being applied in this loading step. The application/deposition of the metal particles is preferably effected by contacting of the fibers with dissolved metal salts or metallocenes (preferably ferrocenes), in particular at a temperature of from 100 to 600° C., and subsequent reduction by means of hydrogen at a temperature of from 300 to 800° C., preferably about 500° C.

In step (c) of the process of the invention, the fibers doped with metal particles are etched. This is effected according to the invention by treatment with water vapor in a helium atmosphere, with the water vapor content of the helium atmosphere preferably being from 0.1 to 10% by volume, particularly preferably about 1% by volume. Preference is also given to the helium atmosphere containing from 1 to 20% by volume, preferably about 10% by volume, of $H_2$ in order to keep the metal catalyst active. Etching is preferably carried out at a temperature of from 500 to 800° C., particularly preferably above 600° C.

In step (d) of the process of the invention, the metal particles are removed. This is preferably achieved by treatment with an acid, in particular aqueous hydrochloric acid or a mixture of $HNO_3/H_2SO_4$.

The carbon fiber obtained in this way can be loaded with functional ligands at the etched positions in a subsequent step (e) as a function of the desired use. Thus, for example, use as catalyst requires loading with the metal atoms/particles required for this purpose.

The present invention is illustrated below for carbon nanofibers. However, this does not restrict the scope of protection of the patent.

Figure 2A:
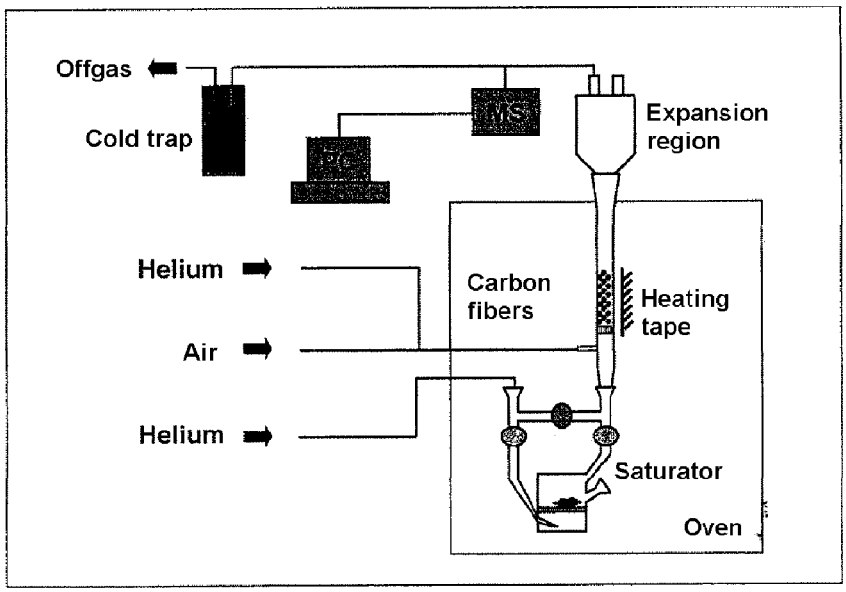
FIG. 2: Schematic depiction of the apparatus for iron deposition (a) and water vapor etching of carbon nanofibers (b).
Figure 2B:
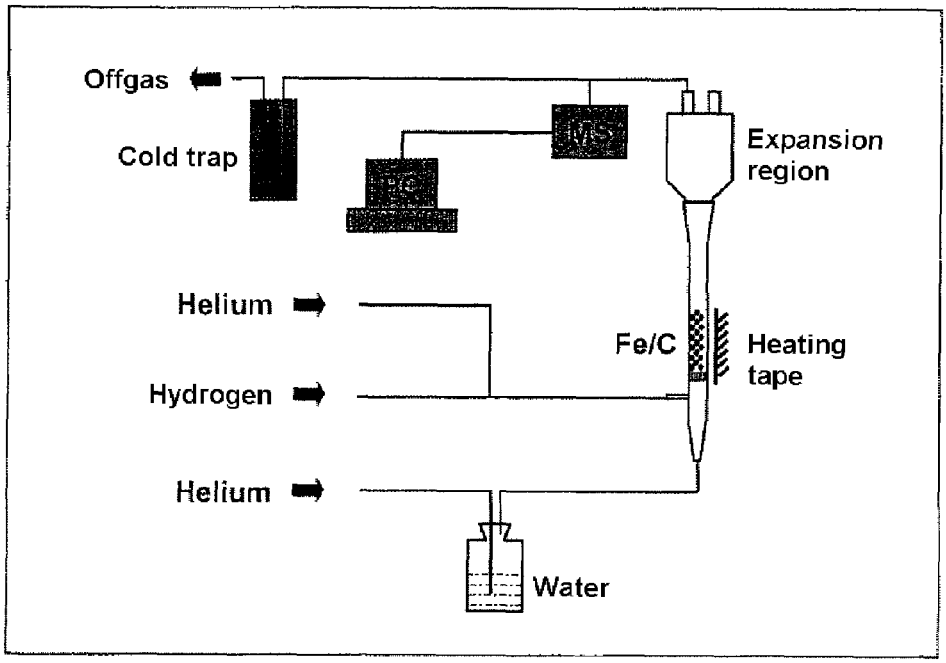
Figure 3:
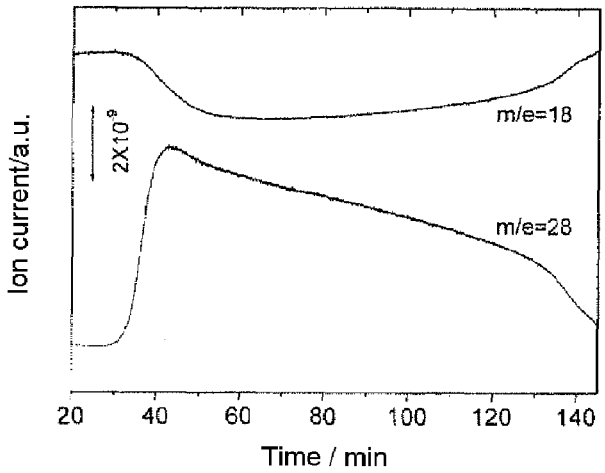
FIG. 3: The consumption of water and the liberation of carbon monoxide during water vapor etching, recorded by on-line mass spectroscopy.

A typical etching process is illustrated in FIG. 1. The MWNTs (internal diameter: some tens of nm; external diameter: about 100 nm; Applied Sciences Inc., Ohio USA) were firstly treated under reflux in concentrated nitric acid for 2 hours and iron was then deposited from ferrocene. The deposition and the sintering of iron nanoparticles is described in detail in Xia, W. et al., Chem. Mater. 17:5737-5742 (2005). The iron loading in the present study varies in the range from 5 to 10% by weight and can be altered by variation of the amount of the ferrocene precursor. The iron-laden nanofibers were reduced and heat treated at 500° C. in hydrogen for 1 hour. Helium is passed through a saturator filled with water (room temperature) and water vapor (1% by volume) is in this way introduced into the reactor (FIG. 2). Hydrogen (10% by volume) was used in order to keep the iron catalysts active. The formation of CO (m/e=28) and the consumption of $H_2O$ (m/e=18) were observed by on-line mass spectrometry at sample temperatures above 600° C. The reaction temperature correlates with the size of the iron particles deposited. A higher initial temperature is necessary for large catalyst particles; deactivation is very rapid for small particles and results in the reaction stopping. It has been found that the iron catalysts can be active for up to 2 hours, depending mainly on the particle size and the reaction temperature.

The removal of the iron particles from the surface of the carbon nanofibers can be carried out by means of aqueous hydrochloric acid or a mixture of $HNO_3$ and $H_2SO_4$, as described in Wue, P. et al., Surf. Interface Anal. 36:497-500 (2004).

Figure 4A:
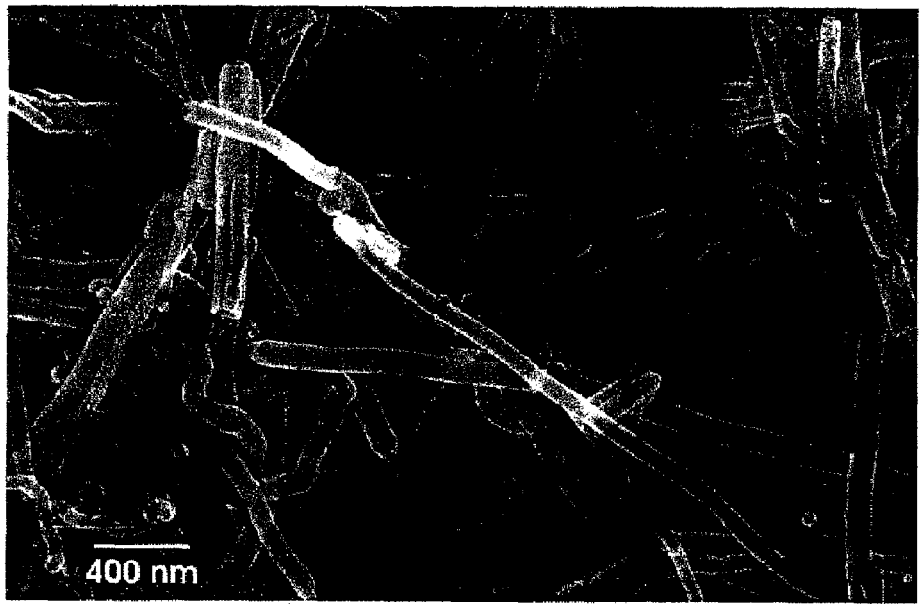
FIG. 4: Scanning electron micrographs of the nanofibers after etching: (a) untreated, with the iron nanoparticles; (b) after removal of the iron nanoparticles by means of 1M nitric acid.
Figure 4B:
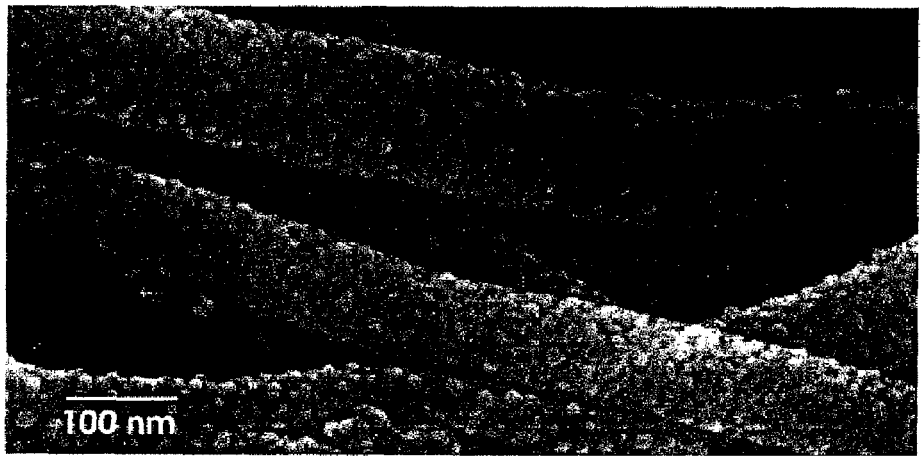
Figure 4C:
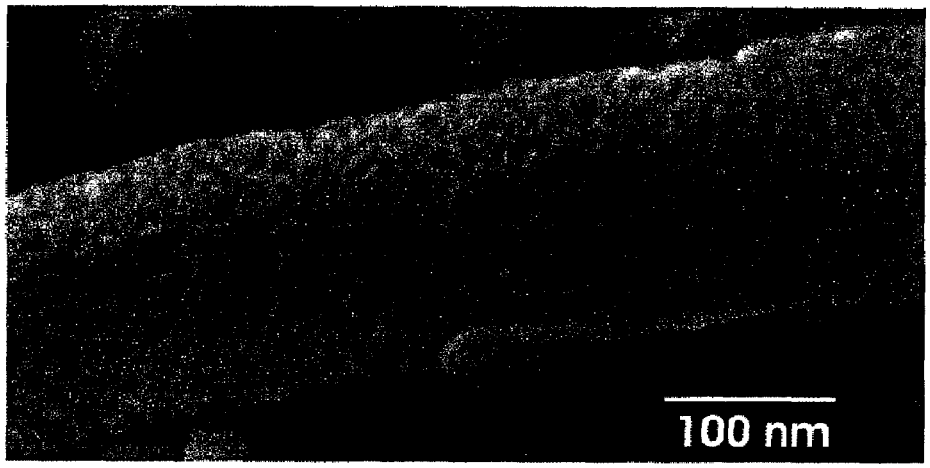
Figure 5A:
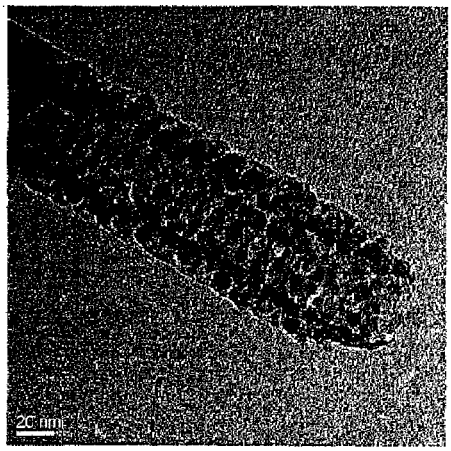
FIG. 5: Transmission electron micrographs of the nanofibers after etching with water at 670° C. (a) untreated, with the iron nanoparticles; (b & c) after removal of the iron nanoparticles by washing with 1M nitric acid; (d) HR-TEM of a wall of a nanofiber destroyed by the etching process.
Figure 5B:
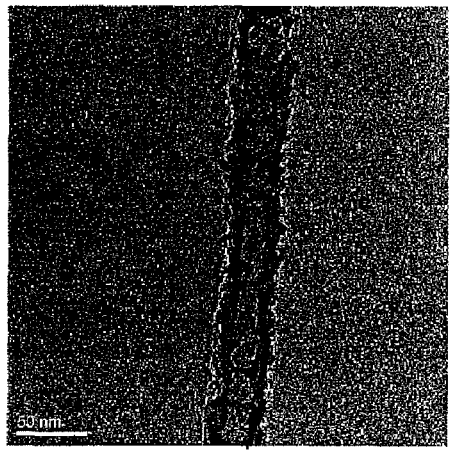
Figure 5C:
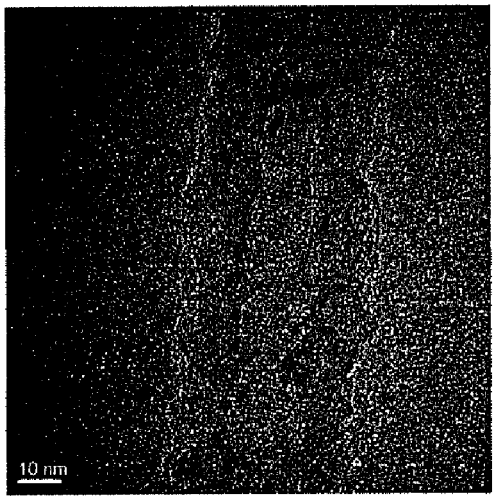
Figure 5D:
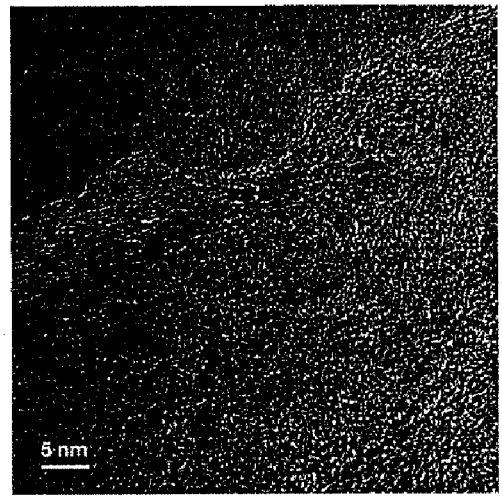

The morphology of the nanofibers was examined by means of SEM. FIG. 4*a* shows the nanofibers in the untreated state. The existence of nanosize iron oxide particles which have been embedded in the surface of the nanofibers in the etched samples can be observed (FIG. 4*b*). The spherical etching pits are clearly visible after the iron particles have been removed by washing with acid (FIG. 4*c*). The transmission electron micrograph shown in FIG. 5*a* demonstrates the embedding of the iron nanoparticles due to the etching process. The surface roughness was increased considerably by etching, as the transmission electron micrographs after washing out of the iron nanoparticles show (FIG. 5*b-c*). In addition, the damage to the wall of the nanofibers can be seen in the high-resolution TEM shown in FIG. 5*d*. A spherical hole has been etched into the nanofiber, obviously by the outer walls being removed successively.

Figure 6:
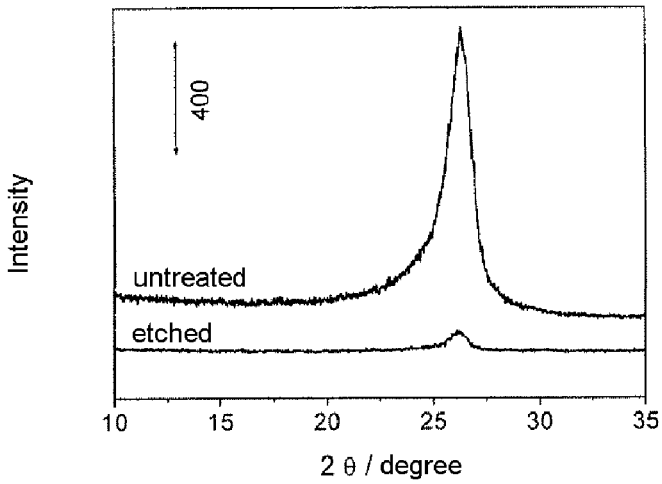
FIG. 6: Powder diffraction patterns of the untreated and etched nanofibers.
Figure 7:
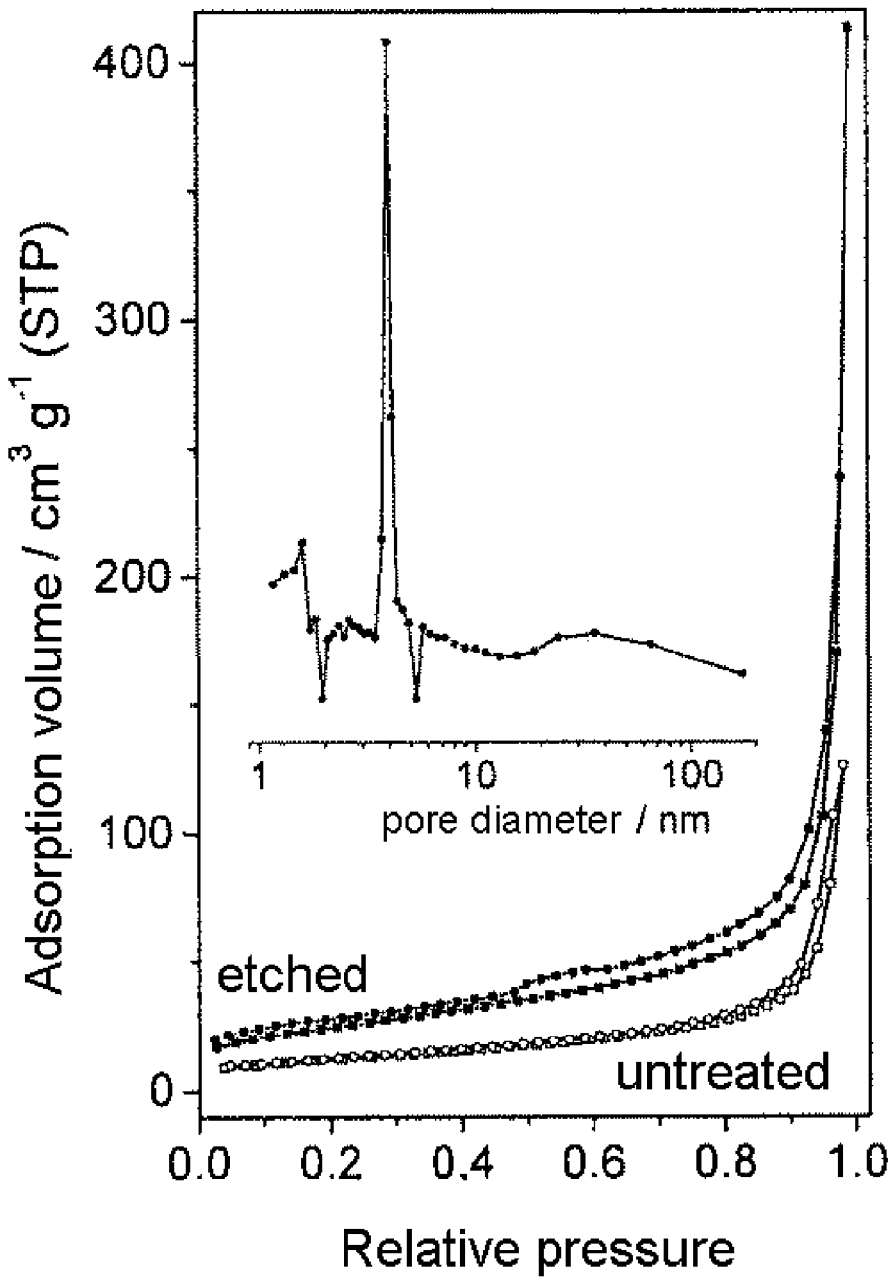
FIG. 7: Isotherms of the nitrogen physisorption measurements for untreated and etched nanofibers. The inset graph shows the pore radius distribution of the etched nanofibers.

The etching over a short period of time results mainly in surface defects without any appreciable changes in the materials properties being observed. On the other hand, the materials properties can be altered significantly by lengthening the etching time. FIG. 6 shows the result of X-ray diffraction (XRD) on nanofibers which have been etched for more than one hour. Compared to the untreated nanofibers, the signal intensity is considerably reduced after etching. Although it is not appropriate to correlate the intensity directly with the crystallinity, a significant increase in disorder after etching can be deduced without doubt from highly reproducible XRD results. Relatively small mesopores were produced by etching, as can be shown by the nitrogen physisorption measurements (FIG. 7). In the case of etched nanofibers, hysteresis between the adsorption and desorption branches of the isotherms was observed and a pore diameter of a few nanometers was deduced (FIG. 7). Such small pores cannot be detected in untreated MWNTs which have virtually perfect parallel walls. As a consequence, the specific surface area of the nanofibers is increased from about 20~40 $m^2/g$ to 90~110 $m^2/g$.

In summary, it can be said that mesoporous MWNTs having spherical etching pits can be produced in a targeted, local etching process which is both environmentally friendly and is based on advantageous raw materials (iron and water). In the innovative process, etching takes place at the surface of the nanofibers and is limited to the interface between the iron particles and the nanofibers. All parts of the nanofiber surface without iron particles are not altered by the etching process. The simple control and variation of the process parameters makes the etching process extremely flexible. Possible uses are in the field of polymer composites, catalysis and biosensors. We assume that the etching pits effectively reduce the surface mobility of deposited nanosize catalyst particles and thus enable the aggregation (sintering) which leads to deactivation of the catalysts to be avoided. In addition, it is expected that the increased surface roughness will be useful for the immobilization of the functional proteins in biosensors and will lead to significantly improved oxygen functionalization.

The invention is illustrated with the aid of the following examples. However, these examples do not restrict the subject matter claimed in any way.

EXAMPLES

Example 1

The iron-laden nanofibers (10% by weight; obtainable from Applied Sciences Inc., Cedarville, Ohio, USA) were reduced and heat treated at 500° C. in a mixture of hydrogen and helium (1:1, 100 ml $min^{-1}$ STP) for one hour. A total gas stream of 100 ml $min^{-1}$ STP having a hydrogen concentration of 10% by volume and a water concentration of 1% by volume was produced as follows: helium (32.3 ml $min^{-1}$ STP) was passed through a saturator filled with water (room temperature). Hydrogen (10 ml $min^{-1}$ STP) and additional helium (57.7 ml $min^{-1}$ STP) were combined with the water-containing helium stream in the reactor upstream of the fixed bed. The hydrogen used (10% by volume) served to keep the iron catalyst active. Control of all gas streams was effected by on-line mass spectroscopy (MS). Since the water signal (m/e=18) was stationary after about 30 minutes, the reactor was heated from 500° C. to 670° C. at a heating rate of 20 K $min^{-1}$. The reaction commenced at about 600° C., as shown mass-spectroscopically by the formation of CO (m/e=28) and the consumption of $H_2O$ (m/e=18). After a further reaction time of about two hours, the reactor was cooled at 10 K $min^{-1}$ to 450° C. under helium (100 ml $min^{-1}$ STP). After a minimum hydrogen signal (m/e=2) had been reached after about 30 minutes, (50 ml $min^{-1}$ STP) together with helium (50 ml $min^{-1}$ STP) was introduced to remove carbon-containing deposits by oxidation. Mass-spectroscopic monitoring of the oxygen signal (m/e=32) showed that elimination of the carbon deposits was complete after about 5 minutes. The reactor was cooled to room temperature. The etched sample ($FeO_x$/CNF) was washed with 1M $HNO_3$ at RT for one hour while stirring, subsequently filtered off and dried for the purpose of further characterization.

Example 2

When the iron loading in the first step is reduced to 5% by weight and all other parameters of Example 1 are kept constant, the reaction time is 1.5 h.

Example 3

When the maximum temperature in the third step is reduced from 670° C. to 650° C. while keeping all other parameters of Example 1 constant, the reaction time is 1 h.

The invention claimed is:

1. An etched carbon fiber which can be obtained by a process, which process comprises the following steps:

(a) functionalizing the surface of the carbon fibers by oxidation to yield carbon fibers having a functionalized surface, (b) depositing metal particles on the functionalized surface to yield carbon fibers having metal particles deposited on the functionalized surface thereof, (c) etching of the surface of the carbon fibers resulting from (b) by treatment with water vapor, and (d) removing the metal particles by acid treatment.

2. A composite, energy store, sensor, adsorbent, heterogeneous catalyst support or a catalytically active material comprising an etched carbon fiber as claimed in claim 1.

* * * * *